US006734421B2

(12) United States Patent
Holle et al.

(10) Patent No.: US 6,734,421 B2
(45) Date of Patent: May 11, 2004

(54) TIME-OF-FLIGHT MASS SPECTROMETER WITH MULTIPLEX OPERATION

(75) Inventors: Armin Holle, Oyten (DE); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 37 days.

(21) Appl. No.: 10/092,026

(22) Filed: Mar. 6, 2002

(65) Prior Publication Data

US 2002/0155483 A1 Oct. 24, 2002

(30) Foreign Application Priority Data

Mar. 15, 2001 (DE) ..... 101 12 386

(51) Int. Cl.[7] ..... H01J 49/10
(52) U.S. Cl. ..... 250/287; 250/288
(58) Field of Search ..... 250/287, 288, 250/281, 282, 423 P

(56) References Cited

U.S. PATENT DOCUMENTS 4,740,692 A * 4/1988 Yamamoto et al. ..... 250/282
5,742,049 A 4/1998 Holle et al.
5,808,300 A * 9/1998 Caprioli ..... 250/288
5,965,884 A 10/1999 Laiko et al.
6,175,112 B1 1/2001 Karger et al.

FOREIGN PATENT DOCUMENTS

DE 196 37 480 C2 3/1998
DE 198 34 070 A1 2/2000
GB 2 236 185 A 3/1991
JP 2000-057992 2/2000
WO WO 98/53308 A1 11/1998

OTHER PUBLICATIONS

H. Vogt et al., Lamma—a new approach for the application of lasers in the analysis of bulk material, Laser und Optoelektronik, 1983, pp. 23–28, Laser–Anwendung, Köln, Germany.

R.J. Conzemius and H.J.SVEC, Analytical Chemistry, Scanning Laser Mass Spectrometer Milliprobe, 1978, pp. 1854–1858, vol. 50, No. 13, American Chemical Society, Iowa.

* cited by examiner

*Primary Examiner*—Kiet T. Nguyen

(57) ABSTRACT

The invention concerns a time-of-flight mass spectrometer for the analysis of a large number of samples on a sample carrier using laser desorption and associated analytical procedures. The invention uses a special beam focusing system for the pulsed laser beam in a time-of-flight mass spectrometer to generate a firm pattern of focal points, inserts a pattern of samples on a sample carrier into the pattern of focal points, and focuses the ions generated in the laser focal points by an ion-optical imaging system onto one or more ion detectors in such a way that the samples in the focus pattern are measured simultaneously or quasi-simultaneously. The pattern of pulsed focal points can be created simultaneously through spatially splitting the beam, or by a temporal sequence of different deflections towards the firm locations of the pattern.

10 Claims, 1 Drawing Sheet

TIME-OF-FLIGHT MASS SPECTROMETER WITH MULTIPLEX OPERATION

FIELD OF THE INVENTION

The invention concerns a time-of-flight mass spectrometer for the analysis of a large number of samples on a sample carrier using laser desorption and associated analytical procedures.

BACKGROUND OF THE INVENTION

Time-of-flight mass spectrometers in which the samples are ionized by pulsed laser desorption operate as follows: the laser beam is focused onto a sample that is held on a sample carrier. A laser desorption pulse generates ions from the analyte molecules. An applied voltage accelerates the ions into a field-free flight tube. Because of their different masses, the ions in the ion source are accelerated to different velocities. The smaller ions reach the time-resolving ion detector earlier than the larger ions. From the measured time-resolved ion currents the flight times of the ions can be determined; from their flight times their masses are calculated. An energy-focusing reflector and a delay in acceleration (often called delayed extraction) are used to increase resolution.

There is a strong trend in biochemistry towards processing and analyzing very large numbers of samples in parallel. The chip technique has become particularly well known. This technique works with large arrays of samples in a very small space. For certain analytical procedures using such sample arrays, e.g. those using fluorescence spectrometry, devices ("chip readers") are already available which permit parallel analyses of all the samples on the chip at the same time; if not strictly simultaneously, they use a laser scanning procedure to read sequentially in only a few milliseconds per sample. In contrast to this, mass spectrometric analysis at present requires a few seconds for each sample, so that it is currently slower than the chip reader by a factor of about 1,000.

The chip technique is primarily used in genetics, but also starts in protein analysis. In genetics, various types of oligonucleotide are usually bonded to the surfaces in the individual compartments of the array. These oligonucleotides serve as detection sequences for amplified DNA samples; they are often referred to as probes. If the DNA in the sample contains a strand that is complementary to the oligonucleotide, then the DNA will attach itself to the oligonucleotide. This attachment is referred to as "hybridization". The attached strands of DNA can, in this process, bring fluorescent dyes with them, or can alter the fluorescence wavelength of fluorescent dyes that are already located at the bonded oligonucleotides. Chips charged in this way can then be measured in the chip readers mentioned above, and the fluorescence of a compartment indicates the presence of the DNA sequence in question.

Mutations such as, for instance, point mutations can also be examined in this way. Point mutations consist of the modification of a single nucleotide. They are nowadays referred to as SNPs (single nucleotide polymorphisms). Because, however, the hybridization temperature (also known as the melting temperature) for mutation sequences and wild type sequences are only minimally different, detection through simple hybridization is always liable to error, because mutation DNA and wild type DNA undergo mixed hybridization in specific ratios, where the ratio depends very strongly on the temperature. In contrast to this kind of mutation detection through simple hybridization, mass spectrometric mutation detection is very reliable and unambiguous.

Mass spectrometric mutation detection is usually based on enzymatic modification of the probes that have been attached to the chips. The modification is controlled by the hybridized template, so that information about the mutations is transferred from the templates to the probes. One of these enzymatic modifications is known as limited primer extension. Preparation of the samples requires more time than simple hybridization, and the measurement also takes longer, because there is as yet no known method of analyzing a large number of samples simultaneously in the way that can be done in those chip readers. Mass spectrometric measurement of mutations has, however, the advantage of high analytic reliability, something which plays a significant role in diagnostic procedures as well as, for instance, in association with police records.

In protein analysis, antibody proteins can be bonded to the array compartments, and these can capture specific proteins from a sample. Other types of protein-specific affinity bonding can also be used for the protein chip technique. Further detail will not be given here of protein analysis, of which an extraordinarily wide variety exists.

As has already been stated, mass spectrometry offers the advantage of high analytic reliability, but this is countered by the disadvantage of the long time needed for the measurement, being some 1,000 times slower than chip readers. This raises the questions of whether and how mass spectrometry can be accelerated, and in particular of whether spectrometry can be carried out on entire arrays of samples.

There is an odd discrepancy in the mass spectrometric analysis of samples with ionization by laser desorption:

It is, on the one hand, possible to manufacture pulsed lasers with high repetition rates in the region of 10,000 pulses per second; this would permit a mass spectrum to be recorded in only about 100 microseconds, which in turn would mean that 10,000 individual spectra could be measured each second. If 10 individual mass spectra (from 10 laser pulses) are required for a sum spectrum that can be effectively analyzed, the analysis could be complete within one millisecond, which compares favorably with fluorescence chip readers.

On the other hand, however, there is a threshold energy for the generation of ions by laser desorption, below which the laser desorption process does not generate any ions at all. This threshold energy significantly heats the sample. For this reason, a laser frequency greater than about 20 Hertz results in excessive heating and degradation of many samples. Each laser desorption process, moreover, causes the samples to become electrically charged, since only particles of one polarity are withdrawn, while those with the opposite polarity are accelerated back onto the sample. Time is therefore necessary, particularly for MALDI samples with their insulating matrix crystals, so that the charges can disperse. Dissipation of the charges is also in many cases made slower because the chips that are used as a substrate for the samples are made of poorly conducting semiconductor material. Electrical charge causes the quality of the spectra to deteriorate, because the ions generated by the sequence of laser desorptions are given different energies. So if the 10 individual spectra required are to have good quality, at least about a half a second has until now been required. In addition to this, further time is needed to move the new sample into the laser focus, and for the data to be read from the transient recorders. These times are considerably longer than a millisecond; they limit the frequency with which individual samples can be measured, even if the laser pulse frequency could be significantly raised.

In theory, therefore, a minimum period of about one second is required for the analysis of a sample, although in practice the analysis times for a sample are longer still, and still require two to three seconds even in laboratories used to the routine.

Forty years ago, however, there were already developments in mass spectrometry in which a micrometric/analytic representation of a small area was created through ionization by secondary ions (SIMS=secondary ion mass spectrometry). The leader in the field was the French firm Cameca, whose devices were ion-optical imaging magnetic sector-field mass spectrometers. They were used for surface analysis, usually of metal surfaces. Light/dark images were used to determine the presence of specific elements or compounds, and their distribution over the surface.

Time-of-flight mass spectrometers have also already been used for the "chemical" representation of surfaces by laser desorption, although without using imaging optics, but with a raster scan procedure in which the sample is moved through the focal point of the pulsed laser beam and the "chemical image" composed in a complicated manner from many hundreds of individual mass spectra (for example, the "Lamma" time-of-flight mass spectrometer from Leybold, developed by Kaufmann and Hillenkamp).

From amongst the various methods of ionization by laser desorption, in recent years the MALDI (matrix assisted laser desorption and ionization) process has gained wide acceptance. The MALDI preparation and measurement process consists of first embedding the analyte molecules on a sample carrier in a solid, UV-absorbing matrix, usually an organic acid. The sample carrier is inserted into the ion source of a mass spectrometer. A short laser pulse, about three nanoseconds long, is used to evaporate the matrix into the surrounding vacuum; the analyte molecule is thus brought into the gas phase. Through impacts with matrix ions created at the same time, the analyte molecule is ionized, if primary ionization has not already occurred during the desorption process.

MALDI is particularly suitable for the analysis of peptides and proteins. The analysis of nucleic acid chains is more difficult, and only achieves adequate quality for short chain nucleic acids. The reason for this is that whereas for the ionization of peptides and proteins only a single proton needs to be captured, for nucleic acids, which are a polyanion with a sugar-phosphate backbone having a multiple negative charge (one negative charge per nucleotide), the process of ionization by the matrix is significantly less efficient. It only functions sufficiently well for very short chains, such as, for instance, for the cleavage products of the extension primers, such as can be created by photo-cleavable linkers.

MALDI ionization creates ions with widely scattered initial velocities, and these can no longer be time-focused, even if an energy focusing reflector is used. The resulting spectra only have moderate resolution. The mass resolution can be improved through a procedure involving acceleration that is only initiated after a delay.

SUMMARY OF THE INVENTION

The invention uses a special beam focusing system for the pulsed laser beam in a time-off-light mass spectrometer to generate a firm-positioned pattern of focal points, inserts a matching pattern of samples on a sample carrier into the positions of the focal points, and focuses the ions generated in the laser focal points by an ion-optical imaging system on to one or more ion detectors.

This can involve a pulsed laser beam being split spatially over a number of laser focal points, so that the samples in the focus pattern are each ionized at the same time, but it is also possible for the laser beam to be deflected over time so that all the samples in the fixed-position focus pattern are subjected to pulsed ionization one after another as in a raster scan. Both the raster scan and the spatially split laser beam pulses are repeated at a frequency that is low enough to be compatible with the samples and the quality of the spectra generated, which depends on the dispersal of electrical charges.

The time-of-flight mass spectrometer according to the invention is defined by the characteristic part of claim 1, and includes those parts of the device that facilitate the above procedure, in particular the beam focusing system for generation of the focus pattern and the ion focusing system for projecting the ions from the focal points onto one or more ion detectors.

In what follows, the term "focus pattern" will refer not simply to the arrangement of the focal points, but in a more general sense to all the places where ions are generated from the samples that are to be analyzed at the same time. The focus pattern has a fixed relationship to the ion-focusing imaging system, and also to the laser system, while the samples themselves are located on a moveable sample carrier plate. The focus pattern can, for instance, be a rectangular field with 4, 9, 16, 25 or 36 focus locations, or may also be a hexagonal field with, for instance, 7 focus locations.

The term "focal point" will refer here to a narrowing of the pulsed laser beam created by a lens or a concave mirror, in such a way that the narrowing creates a pre-determined energy density in a predetermined small area. This is not necessarily the same as focusing in the ordinary sense of the word.

The samples are applied in a pattern to the sample carrier, and the pattern spacing corresponds precisely to the spacing of the focus pattern; it is, however, possible for the sample carrier to have many more samples on it than can be included in one focus pattern. This means that the sample pattern on the sample carrier can be a great deal larger in area than the focus pattern; it is even possible, although this would not have much purpose, for the sample pattern to have a smaller spacing than the focus pattern, so that only every second or third sample would be included in the focus pattern. In any case, it is possible at any one time to move a subset of the total pattern of samples on the sample carrier plate into the focus pattern by moving the sample carrier. The sample carrier then remains stationary until the samples in the subset of the pattern that are now located in the focus pattern have all been analyzed. It is one of the advantages of this procedure that movement of the samples for analysis of the samples in the focus pattern, and therefore also movement of the sample carrier, is no longer necessary, and the time required for this is saved.

The phrase "analysis of a sample" here refers to the recording of a mass spectrum capable of analysis, and its further processing. Usually, a number of individual spectra are combined to form a single sum spectrum for each sample, and only the sum spectrum is considered to be an analytically evaluable mass spectrum. The sum spectrum has a significantly better signal to noise ratio than the individual spectra, and in many cases it is only this that allows effective evaluation.

The ion focusing system may project the streams of ions, originating from the point where the focused laser pulses fall on the individual samples in the focus pattern, onto a single, common ion detector, or on a number of ion detectors. It is possible for the samples in the focus pattern to be ionized simultaneously by a spatially split laser beam having a number of focal points, or it is possible for the samples to be treated individually by one laser beam being diverted cyclically to a new sample each time, so that in each cycle the individual spectra of all the samples in the focus pattern are recorded once each, and the addition of the individual spectra from, for example, 10 cycles yield the sum spectra for the samples.

This gives us the three arrangements of interest according to the invention:

1) The ions from the various samples in the focus pattern are created together simultaneously by a split laser beam and are measured together by one detector. This case corresponds to the multiplexed analysis of one sample with a number of analytes, but has the advantage of separate preparation of the samples, which is sometimes necessary, and the further advantage that suppression effects ("quenching") that are often observed (especially in the case of peptides) during ion generation by the laser desorption pulse do not occur. The laser used here must have an increased beam energy in order to supply the necessary threshold energy to all the samples simultaneously.
2) The ions from the various samples in the focus pattern are created together simultaneously by a split laser beam, but are projected onto different detectors separately through appropriate ion focusing methods, as illustrated in FIG. 1. The signals from the detectors must then be sent in parallel to separate signal processors (post-amplifiers and transient recorders). The laser for this purpose must again have an increased beam energy. The number of post-amplifiers and transient recorders used in parallel must correspond to the number of samples in one focus pattern that are to be analyzed.
3) The ions from the various samples in the focus pattern are ionized, in sequence, in a raster scanning process cyclically by means of rapid diversion of the laser beam, and are measured by a single ion detector with only one post-amplifier and only one transient recorder operating with temporal overlap, as illustrated in FIG. 2. The individual spectra from the samples are stored in separate memory regions of the transient recorder, and, if necessary, may be added there to form a sum spectrum. This requires a laser with a normal energy density in the laser beam, but operating at a frequency increased by a factor corresponding to the number of samples. The transient recorder requires an increased memory size so that it can record all the spectra.

Cases 2) and 3) each supply a separate analysis for each sample. If it is not difficult to increase the laser's beam energy, and if the transient recorders are economically priced, then solution 2) is certainly to be preferred. If, however, it is more economical to increase the laser pulse frequency, and if the transient recorders are relatively expensive, then solution 3) represents the better method. The invention thus allows the price to be optimised. For cases 1) and 3) it is possible not just to use linear mass spectrometers, but also to make use of time-of-flight mass spectrometers with energy-focusing reflectors.

DETAILED DESCRIPTION

If a single ion detector is used for samples ionized symchronously, then the procedure has certain similarities with the familiar multiplexed SNP mass spectrometric analysis, in which various single mutations are measured jointly in a single sample, and in which the products of the sample preparation for the individual mutation measurements must differ sufficiently in their mass. The mass-spectrometric measurement of SNPs yields, in principle, only one or two signals in each spectrum: either single signals of homozygote A or homozygote B, or, in the heterozygotic case, both signals are present. Since the masses are known in advance, it is generally possible to overlay a number of spectra without interference.

When one detector is used according to the invention for the joint measurement of different samples that are ionized at the same time, the masses of the products that are to be measured must be just as clearly distinguished as is the case for multiplex SNP analyses where the different SNPs are measured in one sample. It has, however, been seen that the separate preparation of individual samples can offer advantages. Quenching phenomena also frequently occur in multiplex analyses. What happens here is that a number of analyte molecules battle for the limited number of protons available in the desorption plasma: the analyte with the highest proton affinity wins, and analytes with lower proton affinities can no longer be clearly detected, if at all. These problems do not occur in the analysis procedure according to the invention, in which different samples are ionized simultaneously and subjected to a joint detection.

The projection of the ion currents from the individual, synchronously ionized samples onto different ion detectors can range from several samples for each detector down to a single sample for each detector. Using a number of samples for each detector has the advantage of requiring less expensive electronics for post-processing of the detector signals; in particular, fewer digitizers (transient recorders) are used. In contrast with the case in which all the samples to be analyzed are measured synchronously with just one detector, the risk of overlapping ion signals is lower.

Figure 1:
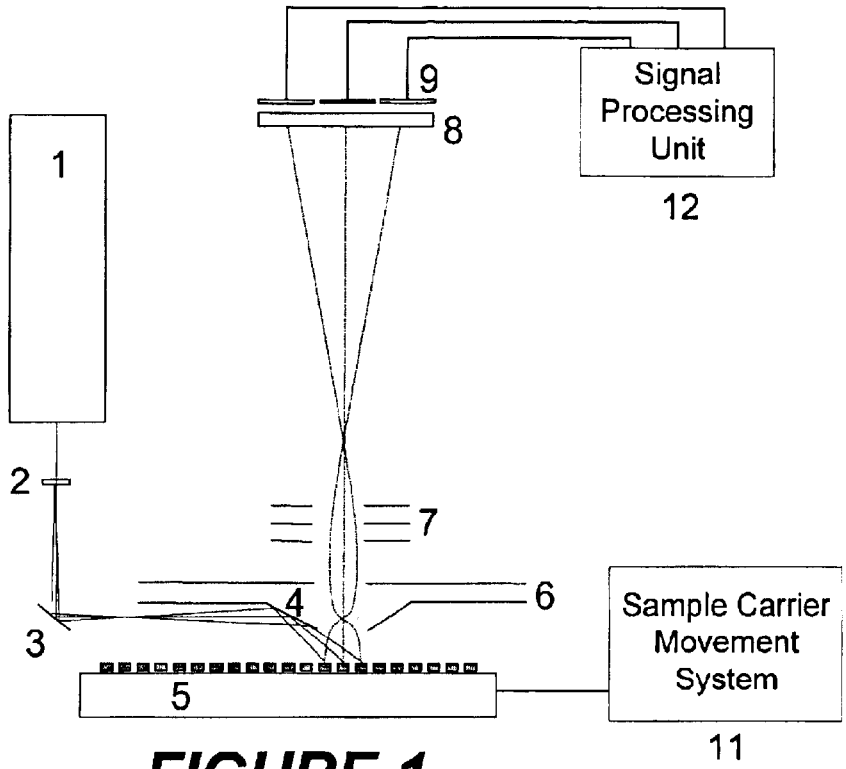
FIG. 1 illustrates in outline the implementation of a time-of-flight mass spectrometer according to this invention. A beam splitter (2) divides the laser beam from the pulsed laser (1), and the partial laser beams are diverted via two fixed-position mirrors (3 and 4) onto the samples located on a sample carrier (5). A movement system 11 is provided for moving the sample carrier. The laser beams are focused by a lens that is not shown, or by a mirror having concave form (3). Nine of the samples (only three of the samples are visible in the side view) are located on the focus pattern, and are ionized simultaneously by the pulse of laser light. The ions from the nine samples are withdrawn by a focusing aperture system (6), and form ion beams (dotted) that are projected by a single lens (7) onto nine partial regions (of which only three are visible) on a channel plate secondary electron multiplier (8). The secondary electron currents amplified in the partial areas arrive at nine anodes (9) (of which three are visible), whose currents are now fed to nine signal processing systems of signal processing apparatus 12. This allows nine samples to be analyzed in the time during which otherwise only one sample would be available.

A case requiring more electronics for unambiguous sample analysis is that in which the ions from each sample are focused onto separate detectors, as illustrated in FIG. 1. In FIG. 1, three rows of three samples are projected onto nine detectors, although only three samples can be seen in the side view. In general, this can involve a small subset of the samples on the sample carrier, for instance also four by four samples, or five by five samples, can be projected onto a corresponding number of detectors. A single spectrum recording process then yields simultaneously 9, 16 or 25 spectra, although this does require 9, 16 or 25 transient recorders to be used. If, additionally, each sample is also analyzed by means of multiplexed analysis of an average of four SNPs, then a single spectrum recording can measure 36, 64 or 100 SNPs at the same time.

As a system of detectors it is possible, for instance, to use a secondary electron multiplier multi-channel plate (MCP) that amplifies the ion currents simultaneously but in spatially separated partial regions, at the output of which then, for instance, 16 receiving electrodes are located for the amplified secondary electron currents. These currents are then each fed to a post-amplifier followed by a digitizer.

For simultaneous ionization of the samples, the laser beam is split in such a way that one focal point is formed for each of the samples. This kind of splitting can, for instance, be achieved through an array of quartz wedges associated with one or more lenses. This does, however, require the beam to have a sufficiently large cross section and an even energy density distribution. For this reason, microdispersion plates, as are familiar from laser pointer technology where they divide the beam to form any desired figure, are better.

If the samples that are to be analyzed simultaneously are very close together, for instance if the total diameter of the partial sample pattern is not more than about 1.5 millimeters, then a single, accelerating ion focusing system can project the samples as a magnified image (as in a slide projector) onto the arrangement of detectors, as shown in FIG. 1. The accelerating system consists of patternless apertures with circular openings, forming a system of drawing lenses and Einzel lenses. One of the Einzel lenses can then be used to adjust the size of the image, and thus to match the detector array.

For larger sample separations, for instance for separations of 2.25 millimeters between the samples, such as is found on a micro-titration plate with 1,536 samples, an individual focusing system can be provided for each sample, beginning, for instance with circular openings of 1 mm each in the first accelerating electrode, which is located about 3 mm in front of the sample carrier plate. The divided laser beam can fall onto the samples at an angle through neighboring holes. After the initial acceleration by focusing systems unique to each sample, and the generation of a common beam of almost parallel individual beams, the total beam from all the samples can be projected through a wide Einzel lens on to the array of detectors.

It is also possible to lead the individual beams to the detectors by means of a system of a ion guide wires. Such a system consists of extremely thin wires at a potential that will attract the ions, around which the ions circulate. Between one ion-attracting wire and the next, there must be an ion-repelling wire. If the initial direction of the ions does not happen to be such that they fall on to the wires, they swing around them in the vacuum without being lost.

The signals from the ion currents from the individual samples can be fed from the detectors to one digitizer each. As long as such fast digitizers are still very expensive, the signal can however also be stored temporarily in an analog store, or delayed in a delay line before it is fed to the digitizer.

It is also, however, possible to use flight paths of different lengths in order to make the ions travel different distances to reach the ion detectors, so that the spectra from individual samples are sent separately in sequence to one digitizer; the extended flight paths then operate as delay lines for the ion signal.

Figure 2:
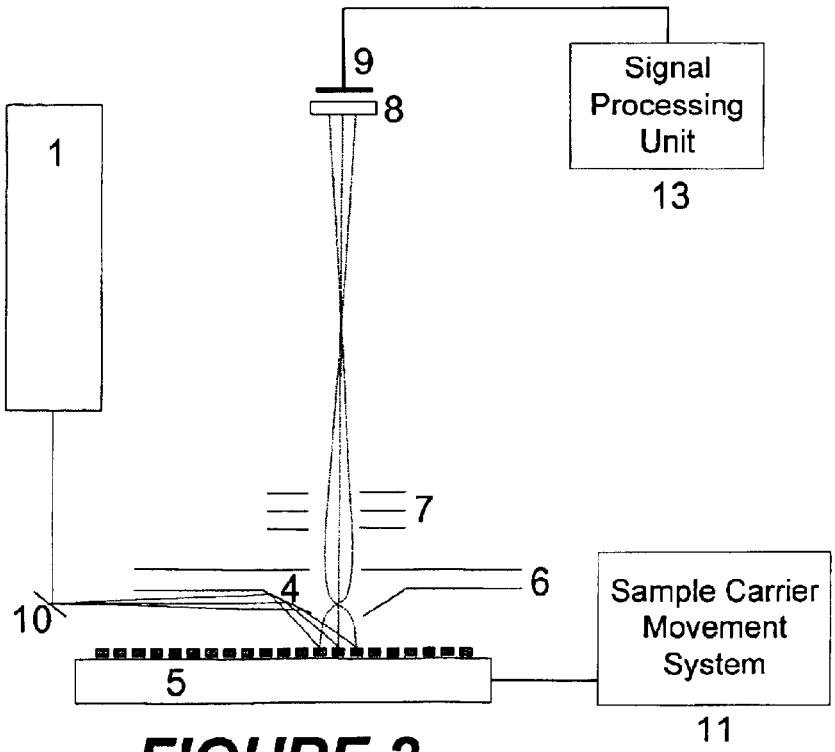
FIG. 2 represents in outline a different implementation of a time-of-flight mass spectrometer according to this invention. The pulses of laser light from a pulsed laser (1) are sent in sequence by a mirror (10) that can be moved piezoelectrically, and by another mirror (4) onto nine samples on the sample carrier (5). A movement system 11 is provided for moving the sample carrier. The beam can again be focused here by a lens, not shown, or by implementing either mirror (10) or (4) in convex form. The nine samples are located in a focus pattern that is generated in sequence. The ion streams from the nine samples (of which three are visible) are now projected in sequence by the accelerating aperture system (6) and the single lens (7) onto the channel plate of the secondary electron multiplier, amplified there as secondary electron currants, and collected by an anode collector (9). The spectral currents collected one after another are now fed to a single signal processing system 13 that can handle the spectra from the samples separately, because these arrive one after another.

The focus pattern can, however, also be created through a temporal sequence of pulsed focal points, as is shown schematically in FIG. 2. A very fast deflecting mirror (10), perhaps driven piezo-electrically, generates the focus pattern here in time sequence. Such fast deflecting mirrors are known from laser scanners. These focus patterns even have the advantage that they are easy to adapt to the spacings of a given sample pattern by using different adjustment constants in the electronic unit that controls the deflecting mirror. Since the deflecting mirrors have extremely little mass, the move from one focal point to another between recording the individual spectra can be achieved in milliseconds.

The ions from the various samples created by a temporal focus pattern are projected by an ion focusing system onto a single ion detector (8, 9). The spectra from the various samples are separated by the fact that they are recorded with a time displacement. In this way, a raster scan is used to record the first individual spectra from all the samples, all using the same ion detector, the same pre-amplifier and transient recorder, where the interesting parts of the flight time spectra of each sample are stored in a different memory area of the transient recorder. When the first raster scan is complete, then after an appropriate interval the second raster scan is recorded, and the second series of spectra is added to the spectra from the first series. This process is continued until a sufficiently large number of individual spectra have been added to form the sum spectra.

If a high spectral quality with high mass resolution is desired it is possible here to use an acceleration that is initiated for each individual spectrum only after a delay. The use of a single ion detector also makes it possible to use an energy focusing reflector. Gridless reflectors permit additional solid angle focusing.

It is advantageous here to clock the laser, and possibly also the acceleration electronics, uniformly. This means that the individual spectra are recorded in a rhythm that continues uniformly through the various raster scans. This causes the thermal conditions that arise in the laser and in the supply units for the accelerating electronics to retain their equilibrium, which in turn it yields a uniform spectral quality.

A particularly favourable embodiment is now described here, specially appropriate for genome studies; the specialist can, however, transfer the fundamental principles of the idea of the invention to other application areas, and which have different special requirements.

The analytic task treated particularly here is the generation of a SNP profile characterizing the genotype from a DNA sample. The profile may, for example, prove the identity of a person or animal, to provide evidence, for instance, of responsibility for certain actions, or to exclude the possibility of substitutions (for instance for horses in horce races); but it can also provide evidence of paternity. A human can be uniquely identified through about 50 SNPs. A genotype profile can, however, also be created for the detection of predisposition to disease with the aim for prevention, or for an individualized medication (the "personal pill"). It can be foreseen that such measurements of genotype profiles, requiring high analytic reliability, will play an important role in medicine in the future, and in animal and plant breeding. To date, only mass spectrometry can guarantee the necessary high analytic reliability.

A procedure is now described here in which 288 SNPs in a DNA sample are measured with high analytic reliability, and which can be carried out quickly and easily. It is not difficult to implement the process for other numbers.

To do this, the DNA sample is first prepared for a multiplex polymerase chain reaction (PCR), through the addition of 288 primer pairs as well as a solution consisting of polymerase, the four dNTPs (deoxynucleoside triphosphates) and buffers. The primer pairs are selected in such a way that they all satisfy the PCR conditions for successful amplification; nowadays computer programs are available that can successfully make this choice. Each primer pair now creates a DNA segment that includes an SNP mutation location. The DNA segment should have a length of about 60 or 100 nucleotides.

The subsequent amplification through the known temperature cycles thus yields for each of the selected SNPs a double strand segment of DNA, which carries the SNP location not far from its centers. Following the amplification, many billions of each of these DNA segments are present. These DNA segments can, for instance, be adsorptively bound to small magnetic spheres, allowing them to be washed to purify them of any additives. Following the washing process, polymerase, buffer and NTPs are added again to the DNA segments for limited primer extension. This time, the NTPs involved are dideoxynucleoside triphosphates (ddNTPs) and these, as they bond to the extension primer, prevent any further extension, so terminating the extension.

It is favourable for all these processes to be carried out in what are known as microtitre plates (MTPs). They may have, for instance, 96 individual wells in a plate of largely standard design with a size of about 8 by 12 centimeters.

Chips carrying the extension primers are now introduced to these wells, and the further sample preparation up to the mass spectrometric analysis takes place on these. The chips are about 3.5 by 3.5 mm in size, and on an area of 3 by 3 mm have a total of 144 compartments. Each square compartment has an edge length of 200 micrometers, and between the compartments there are hydrophobic separating tracks, 50 micrometers wide. Each of the nine square millimeters of the active chip area thus contains 16 compartments, whose 16 samples will later be jointly measured in a raster scan.

Four extension primers of a special type are now placed into each compartment. The extension primers are chosen in such a way that they hybridize with their 3' end immediately next to a mutation location with one of the single strands of DNA obtained from the double strand segments. Two extension primers are provided here for each DNA double strand segment: one for each of the two single strands. These two primers are the basis for two independent analysis procedures for one mutation each; this internal cross-check provides an exceptionally high analytic reliability, even without the double determination that is usual in medicine.

These primers are bound to the surface of the chip with their 5' end. As usual, they are about 20 nucleotides in length, but they have a photo-splittable linker exactly four nucleotides from their 3' end. This linker bridges precisely one nucleotide, and disturbs neither the hybridization nor the enzymatic extension through specially applied polymerase.

After the chips are inserted into the wells with the amplified DNA segments, the limited primer extension now begins. Through the usual temperature cycles, the single DNA strands are bound to the extension primers, and the extension primers are extended by precisely one nucleotide. This nucleotide reflects exactly the type of the mutation location, because the output DNA serves as a template for the extension.

After the limited extension of the extension primers bonded to the chips, the chips are washed and freed of all polymerase, buffers, ddNTPs and templates. Only the extension primers remain on the chip. The chip is then dried, and exposed to UV radiation. This radiation splits the linkers; the ends of the primers become free. These ends, however, carry the information about the mutation location, and their mass can be measured, because the various nucleotides differ by at least 9 but at most 40 atomic mass units. The split segments are always exactly five nucleotides in length; the masses of these end pieces lie between about 1,600 and 1,800 atomic mass units.

These end segments are now taken up by a matrix solution that is applied for ionization by matrix assisted laser desorption and ionization (MALDI), and prepared for mass spectrometric analysis by drying.

Using mass spectrometers of the most modem class known until now, such samples can be measured in no more than 2 seconds each. If the 96 chips, with 144 samples each (each having 4 multiplexed SNPs) are to be measured, the process will take about eight hours. In comparison with the preparation of the samples, which can be completed in about two hours, this is far too long.

The situation, however, is quite different with a mass spectrometer according to this invention. If 16 samples situated on one square millimeter are measured at once, then the mass spectrometric part of the analysis takes only half an hour, still assuming that the analysis of each sample takes two seconds. Since, however, the movements between the 16 samples are no longer necessary, the analysis can be completed in one second, and the full analysis time is reduced to a quarter of an hour.

It is appropriate here to use a mirror deflection unit that creates the focal points of the focus pattern in time sequence, and an ion focusing system that projects the ions from all the samples onto an ion detector. The ion currents from the samples are thus processed by a single transient recorder one after another, with only that portion of the ion current corresponding to the flight times for masses in the range between 1,600 and 1,800 atomic mass units being stored. After recording each of the 16 sum flight time spectra they are passed to a computing unit that calculates the masses, determines the genotype profile, and extracts the medical or other relevant information from them.

What is claimed is:

1. Time-of-flight mass spectrometer for the analysis of samples, comprising (a) a sample carrier with spatially separated samples, (b) a pulse laser for ionizing the samples by laser desorption of a sample positioned in a laser beam focus point, (c) an ion detector having a high level of time resolution for the measurement of ion current, (d) an optical system for the pulse laser beam directing the focus points sequentially in time onto a pattern of fixed focus points, matching the relative positions of at least a subset of the spatially separated samples on the sample carrier, (e) a movement system for the sample carrier capable to bring at least a subset of the samples into the laser focus point pattern, and (f) an ion focusing system projecting all the ions created at the focus points by the ionizing laser desorption pulses onto the ion detector.

2. Time-of-flight mass spectrometer as in claim 1 wherein the focus pattern has 4, 7, 9, 16, 25 or 36 focal points.

3. Time-of-flight mass spectrometer as in claim 1 wherein the sample carrier has a large number of spatially separated samples forming a pattern, the spacings of which correspond to the spacings of the focal points in the focus pattern.

4. Time-of-flight mass spectrometer according to claim 1 wherein the ion spectra from more than one pulsed laser desorption of the sample are required for the analysis of each sample.

5. Time-of-flight mass spectrometer as in claim 1 wherein a moving deflection system deflects the laser beam focus in time sequence into the focal points of the focus pattern, and wherein the ion currents from the samples are measured in time sequence at the ion detector.

6. Time-of-flight mass spectrometer as in claim 1 further comprising a signal processing apparatus including a fast digitizer and sufficient memory storage space to allow storage of the spectra of different samples in different memory locations.

7. Time-of-flight mass spectrometer as in claim 6 wherein an ionizing laser pulse desorption method is applied to the samples in the focus pattern cyclically, wherein each sample is only subjected to laser desorption once in each cycle across the focal points of the focus pattern, and wherein the respective spectra from the samples over a number of cycles are summed together.

8. Method for the analysis of samples in a time-of-flight mass spectrometer by laser desorption using a pulsed laser for ionization, comprising the following steps:

a) generating a fixed-position pattern of focal points for the laser beam by a beam focusing system, b) introducing a number of samples on a sample carrier to the locations of the focal points of the focus pattern simultaneously, c) directing laser beam energy to each of the focal points sequentially in time to create ions from all the samples that are positioned at the laser focal points by pulsed laser desorption, and d) collecting the ions by an ion-focusing system and projecting the ions to one or more ion detectors.

9. Method as in claim 8 wherein ion currents from the samples are measured in time sequence using one ion detector.

10. Method as in claim 8 wherein a moving deflection system deflects the laser beam focus in time sequence into the focal points of the focus pattern.

* * * * *